US006726609B2

(12) United States Patent
Kuo

(10) Patent No.: US 6,726,609 B2
(45) Date of Patent: Apr. 27, 2004

(54) BACK EXERCISE MACHINE

(76) Inventor: Chung-Jen Kuo, No. 3, Lane 34, Huandung Rd., Yangmei Jen, Taoyuan (TW)

( * ) Notice: Subject to any disclaimer, the term of this patent is extended or adjusted under 35 U.S.C. 154(b) by 0 days.

(21) Appl. No.: 10/298,603

(22) Filed: Nov. 19, 2002

(65) Prior Publication Data

US 2004/0005971 A1 Jan. 8, 2004

(30) Foreign Application Priority Data

Jul. 4, 2002 (TW) ..... 91210129 U

(51) Int. Cl.[7] ..... A63B 26/00

(52) U.S. Cl. ..... 482/142; 482/147; 482/148; 482/907; 482/743; 482/144

(58) Field of Search ..... 482/148, 147, 482/907, 908, 143–4, 95–96, 91, 122–130

(56) References Cited

U.S. PATENT DOCUMENTS 6,179,757 B1 * 1/2001 Koenig ..... 482/97

6,287,243 B1 * 9/2001 Isom et al. ..... 482/142

* cited by examiner

*Primary Examiner*—Nicholas D. Lucchesi
*Assistant Examiner*—C Amerson
(74) *Attorney, Agent, or Firm*—Browdy and Neimark, P.L.L.C.

(57) ABSTRACT

The present invention provides a back exercise machine, which includes a support frame, a footrest, a protrusion device, and a grasping device. The support frame is disposed with a main post thereon. The footrest is mounted on a front end of the support frame. The protrusion device, which is composed of at least two struts pivotally interconnected with one another, is pivotally connected with the main post of the support frame for rendering a raising action and is installed with at least one elastic member between the struts for resiliently self-rebounding. The grasping device is mounted on the protrusion device for the user's two hands holding. In operation, the back exercise can raise the user's back to completely stretch the user's back extensor muscles so as to get rid of weariness by means of the protrusion device's struts pivoting with one another.

9 Claims, 4 Drawing Sheets

BACK EXERCISE MACHINE

FIELD OF THE INVENTION

The present invention relates generally to exercise machines, and more particularly to a back exercise machine.

BACKGROUND OF THE INVENTION

As illustrated in FIG. 1, a conventional back exercise machine 1 is composed of a base 2, a seat set 3, and a footrest 4. The seat set 3 is pivotally mounted on the base 2 and an elastic member 5 is connected between the seat set 3 and the base 2. Referring to FIG. 2, when a user sits on the seat set 3, the user has two feet holding the footrest 4 and his/her back resisting against the seat set 3 such that the seat set 3 pivots backward. In the meantime, the elastic member 5 will generate resistance while the user's back resists against the seat set 3. Accordingly, the user can effectively lie and try to strengthen his/her back by doing the aforementioned action repeatedly.

However, the conventional back exercise machine 1 is just used for doing the aforementioned action, which is a simple back-decline action that fails to stretch back extensor muscles and to revolve the problems of habitually back pains resulting from tense lumbar and back extensor muscles for sedentary persons who works in the offices, drives in cars, and so on.

SUMMARY OF THE INVENTION

The primary objective of the present invention is to provide a-back exercise machine, which can effectively raise a user's back upward and stretch his/her back extensor muscles so as to get rid of weariness.

In keeping with the principle of the-present invention, the foregoing objective of the present invention is attained by the back exercise machine, which comprises a support frame, a footrest, a protrusion device, and a grasping device. The support frame is mounted with a main post thereon. The footrest is mounted on a front end of the support frame. The protrusion device, which is composed of at least two struts pivotally interconnected with one another, is pivotally connected with the main post of the support frame for rendering a raising action and is installed with at least one elastic member between the struts for resiliently self-rebounding. The grasping device is mounted on the protrusion device for the user's two hands holding.

In operation, the back exercise in accordance with the present invention can raise the user's back to completely stretch the user's back extensor muscles so as to get rid of weariness by means of the protrusion device's struts pivoting with one another.

DETAILED DESCRIPTION OF THE INVENTION

Figure 1:
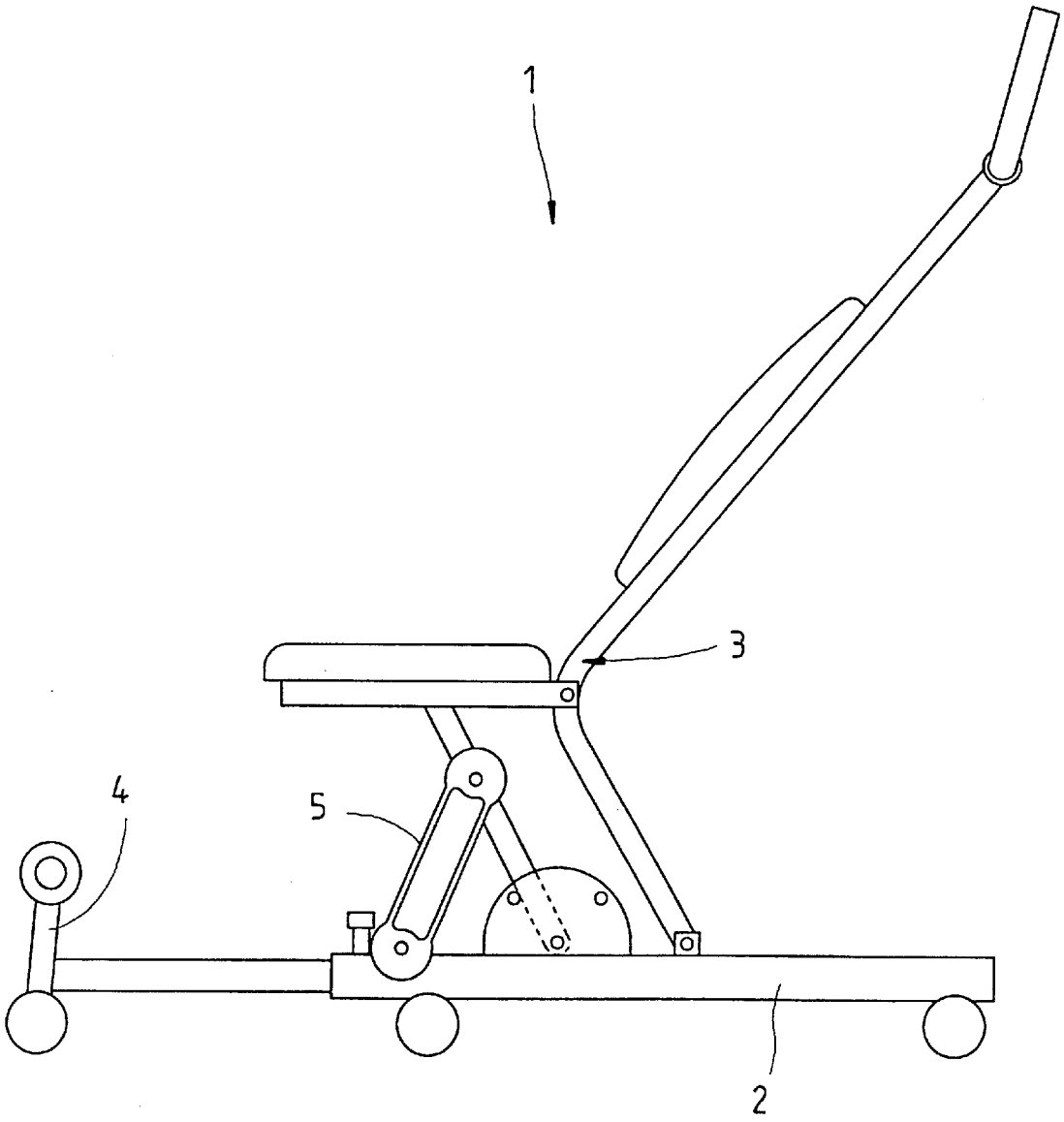
FIG. 1 PRIOR ART
FIG. 1 is a side view of a prior art.
Figure 2:
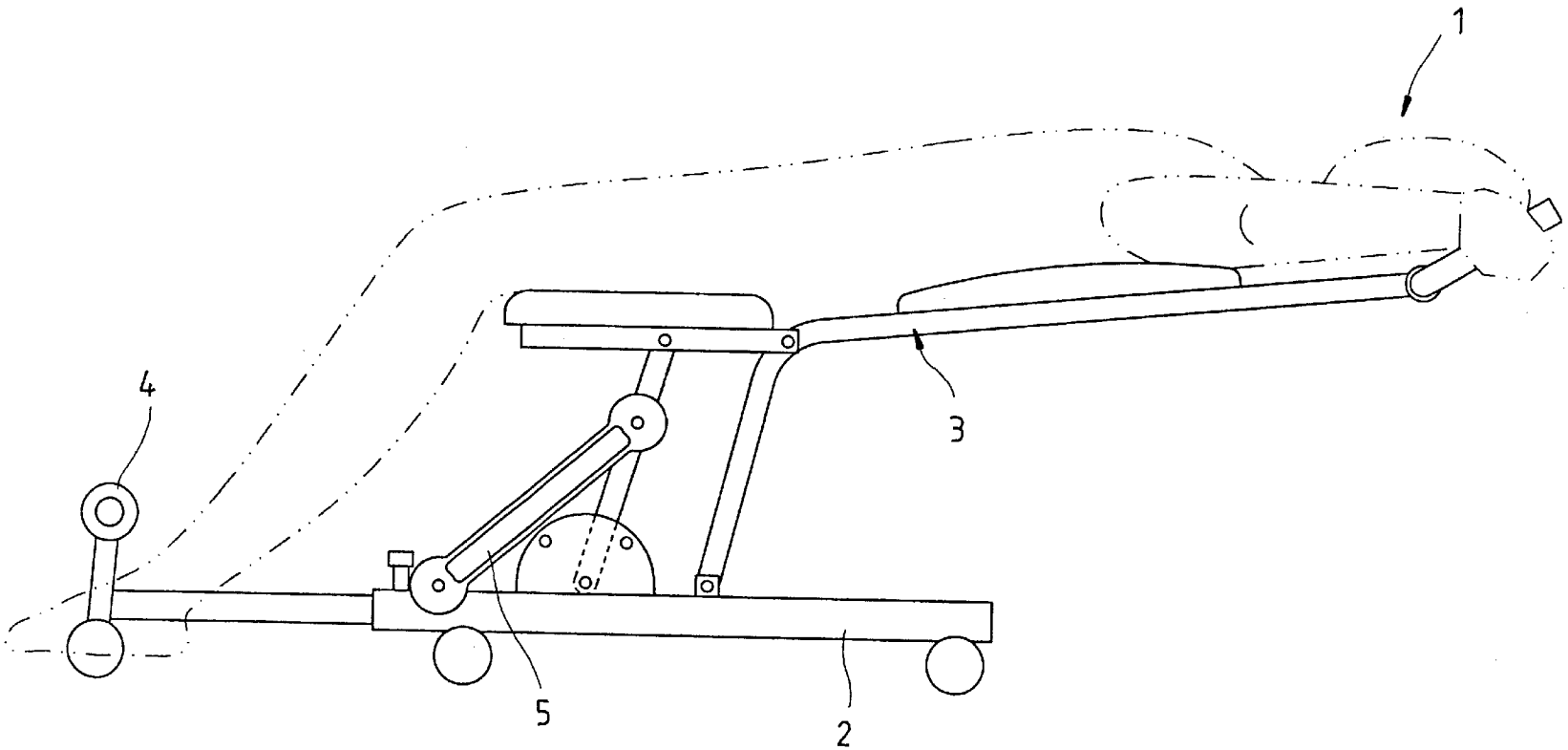
FIG. 2 PRIOR ART
FIG. 2 is a schematic view of the prior art at work.
Figure 3:
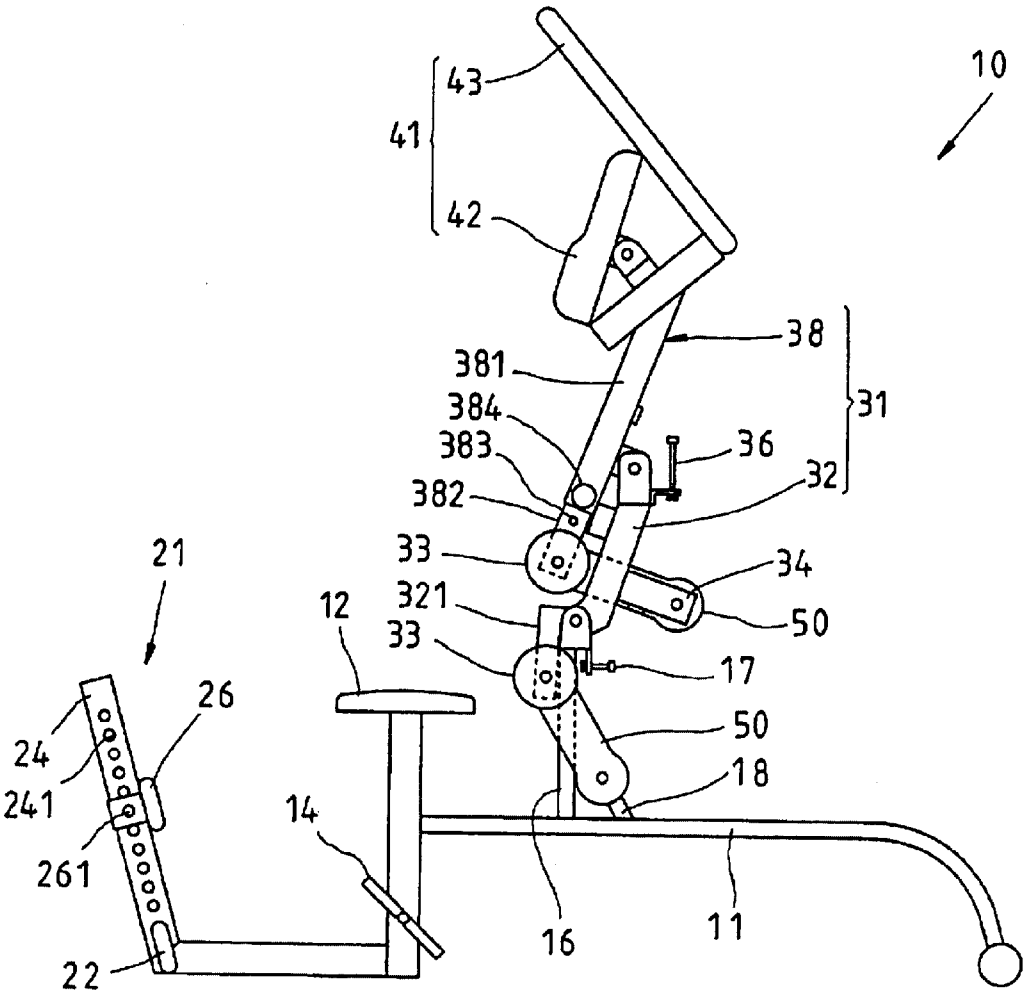
FIG. 3 is a side view of a preferred embodiment of the present invention.
Figure 4:
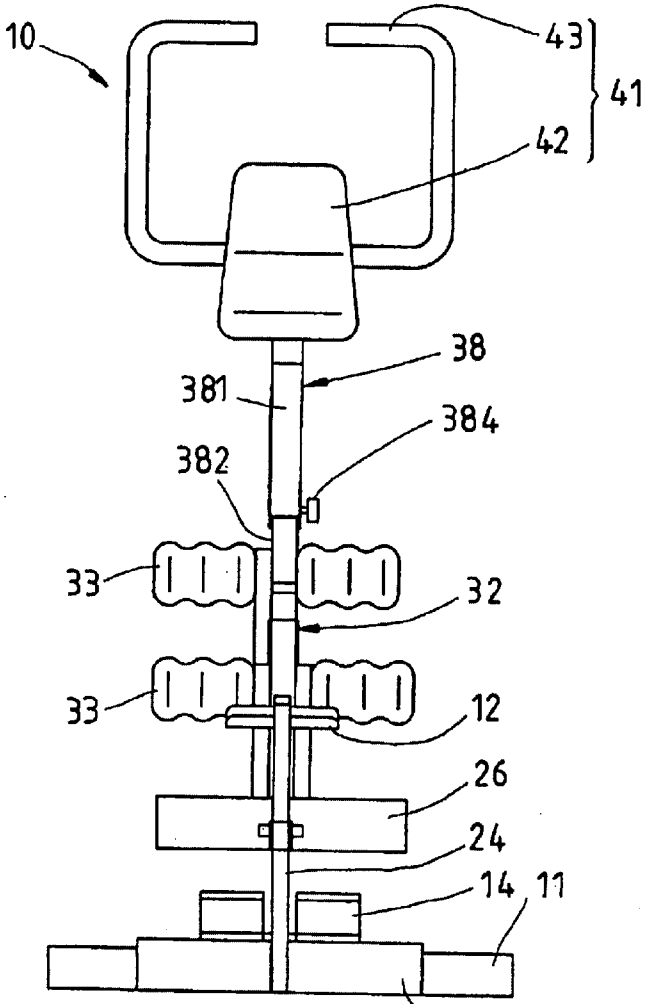
FIG. 4 is a front view of the preferred embodiment of the present invention.

Referring to FIGS. 3–4, the present invention provides a back exercise machine 10, which is composed of a support frame 11, a footrest 21, a protrusion device 31, and a grasping device 41.

The support frame 11, which is substantially U-shaped, is disposed with a seat 12 extending upwardly from a front end thereof, a pedal 14 respectively at left and right sides of a lower side of the front end thereof for a user's two feet stepping, and a main post 16 protruded upwardly from the middle section thereof A first retaining member 17 is mounted on the main post 16 of the support frame 11. A slopping strut 18 is mounted on the support frame 11 and beside the main post 16.

The footrest 21, which is provided with a base bar and a locating bar 24 connected end by end with each other, is substantially L-shaped and is connected to the front end of the support frame 11. The footrest 21 is provided with a first bar 22 extending bilaterally from a position where the base bar and the locating bar 24 are connected. The locating bar 24 is provided with a plurality of through holes 241 thereon and is sleeved with a second bar 26, on which a locking member 261 is mounted. The locking member 261 is provided for corresponsively inserting into one of the through holes 241. By inserting the locking member 261 into different through holes 241, the height of the second bar 26 positioned on the locating bar 24 is thereby adjustable. The first bar 22 and the second bar 26 are provided for the user's two feet resting thereon.

The protrusion device 31 is composed of a first strut 32 and a second strut 38, which are relatively pivotally connected with each other. The first strut 32 is provided with a bending extending portion 321 at the rear section thereof and is pivotally connected with a top end of the main post 16 of the support frame 11 at the bending section of the extending portion 321 such that the first strut 32 is pivotable in relation to the main post 16 by using the top end of the main post as a pivot point. An elastic member 50 is connected end by end between a distal end of the first strut 32 and the slopping strut 18 of the support frame 11 for generating a rebounding resilience while the first strut 32 pivots and the elastic member 50 is stretched. The first strut 32 is disposed bilaterally respectively with a cylindrical rubber pad 33 at a distal end of the extending portion 321 thereof The first strut 32 is disposed with a locating rod 34 protruded outwardly from the middle section thereof and a second retaining member 36 on a top end thereof The second strut 38 is composed of a hollow tube member 381 and a connecting bar 382, which is coupled into the hollow tube member 381 end by end and is provided sequentially with a plurality of through holes 383. The hollow tube member 381 is disposed with a bolt 384 for inserting into one of the through holes 383 and for fixedly interconnecting the hollow tube member 381 and the connecting bar 382 with each other. By inserting the bolt 384 into different through holes 383, a position of the connecting bar 382 coupled into the tube member 381 is thereby adjustable. The hollow tube member 381 of the second strut 38 is pivotally connected with the top end of the first strut 32, such that the second strut 38 can pivot relative to the first strut 32. Another elastic member 50 is connected between a distal end of the connecting bar 382 and a top end of the locating rod 34 of the first strut 32 for generating the rebounding resilience while the second strut 38 pivots and the elastic member 50 is stretched. The second strut 38 is also bilaterally respectively disposed with one of the rubber pads 33 at the distal end of the connecting bar 382.

The grasping device 41 is fastened on a top end of the second strut 38 of the protrusion device 31 and is disposed with a headrest 42 made of a flexible rubber material for the user's head resting. Additionally, the grasping device 41 is bilaterally respectively provided with a handle 43 extending upwardly from a top end thereof for the user's two hands holding.

Figure 5:
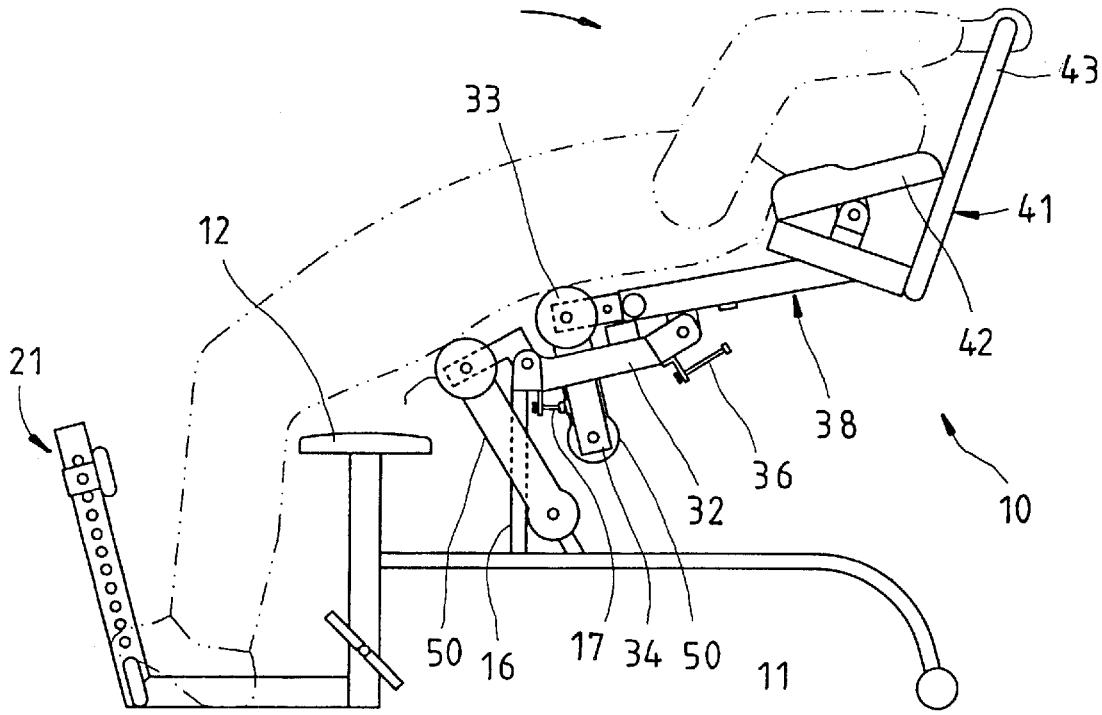
FIG. 5 is a schematic view of the preferred embodiment of the present invention at work.
Figure 6:
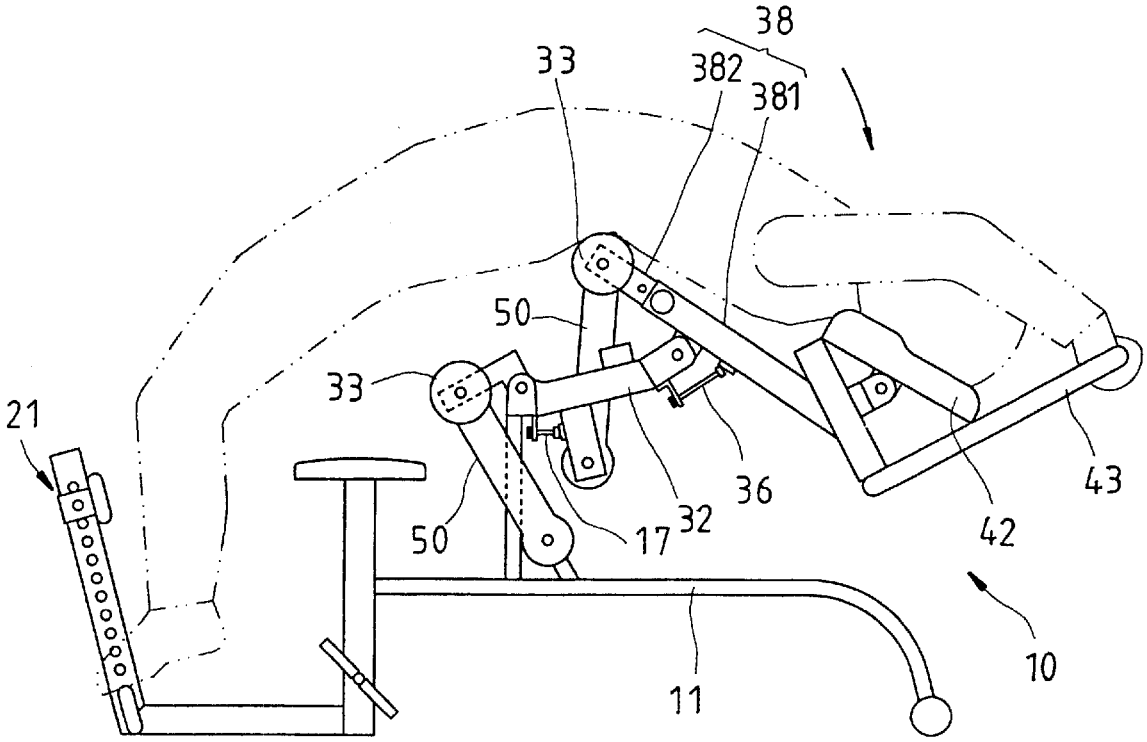
FIG. 6 is a schematic view of the preferred embodiment of the present invention at work, showing that the present invention is operated at a maximum angle of decline.

Referring to FIG. 5, when the user sits on the seat 12 with two hands holding the handle 43 of the grasping device 41 and lies backward, the first strut 32 is exerted to pivot backward and will not stop pivoting until the locating rod 34 contacts the first retaining member 17 of the main post 16. And then the user can keep exerting backward by his/her back and two hands such that the second strut 38 keeps pivoting backward. In the meantime, as illustrated in FIG. 6, the cylindrical rubber pads 33 of the second strut 38 will not stop raising the user's back upwardly until the hollow tube member 381 of the second strut 38 contacts the second retaining member 36. Accordingly, the user's back will get completely stretched and further get rid of muscle strain such that the user will feel quite comfortable.

When the user relaxes his/her whole body, the protrusion device 31 is exerted by the rebounding resilience of the elastic members 50 so as to slowly return to a position where the protrusion device 31 is not exerted by the user.

Alternatively, the first retaining member 17 mounted on the main post 16 and the second retaining member 36 mounted on the first strut 32 can be respectively interchangeably an adjustable screw. Accordingly, sports injuries resulted from the protrusion device's 31 pivoting at a large angle can be effectively prevented by adjusting positions of the two retaining members 17 and 36. Additionally, the elastic members 50 can be formed of rubber tensile sheets, which has proper resilience and can be installed on the back exercise machine 10 of the present invention in more or less quantity on the basis of the user's requirement.

Therefore, the back exercise machine 10 of the present invention includes advantages described in details below:

1. The protrusion device's pivoting results in effectively raising the user's back, thereby the user feels comfortable at his/her back and further gets rid of weariness.

2. A position of the second strut supporting the user and a position of the footrest are adjustable, thereby users having different stature can operate the present invention.

As a conclusion, the back exercise machine provided by the present invention is structurally simple and can effectively raise the user's back and then stretch sedentary persons' back extensor muscles, thereby their weariness can be eliminated.

What is claimed is:

1. A back exercise machine, comprising:

a support frame provided with a seat and a main post beside said seat;

a footrest mounted on a front end of said support frame for a user's two feet stepping thereon;

a protrusion device pivotally connected on said main post of said support frame and having at least two struts pivotally connected with one another for raising the user's back, at least one elastic member being connected between said struts, whereby said protrusion device is capable of resiliently self-rebounding; and a grasping device mounted on said protrusion device for the user's two hands holding.

2. The back exercise machine as defined in claim 1, wherein said footrest is substantially L-shaped and comprises a base bar and a locating bar connected end by end with each other, and a first bar extending bilaterally from a position where said locating bar and said base bar are connected.

3. The back exercise machine as defined in claim 2, wherein said locating bar of said footrest is provided with a plurality of through holes; wherein said footrest further comprises a second bar slidably sleeved on the locating bar, and a locking member mounted on said second bar for corresponsively inserting into one of said through holes of the locating bar.

4. The back exercise machine as defined in claim 1, wherein said protrusion device comprises a first strut and a second strut pivotally connected with each other, said first strut having an end pivotally connected with said main post of said support frame and the other end pivotally connected with said second strut.

5. The back exercise machine as defined in claim 4, wherein said first strut and said second strut are installed with an elastic member therebetween for generating a rebounding resilience when said two struts pivots with each other and said elastic member is stretched.

6. The back exercise machine as defined in claim 4, wherein said first strut and said second strut are respectively provided at distal ends thereof with a rubber pad extending bilaterally.

7. The back exercise machine as defined in claim 4, wherein said second strut comprises a hollow tube member and a connecting bar, said connecting bar being coupled into said hollow tube member and provided sequentially with a plurality of through holes thereon, said hollow tube member being disposed with a bolt for inserting into one of said through holes of the connecting bar, such that said hollow tube member and said connecting bar are fixedly interconnected with each other.

8. The back exercise machine as defined in claim 4, wherein said first strut and said support frame are installed with an elastic member therebetween for providing a rebounding resilience while said first strut pivots relative to said support frame.

9. The back exercise machine as defined in claim 1, wherein said grasping device respectively comprises a handle extending upwardly at the left and right sides of a top end thereof.

* * * * *